United States Patent [19]

Satomi et al.

[11] 4,218,128

[45] Aug. 19, 1980

[54] DUPLEX COPYING MACHINE

[75] Inventors: Toyokazu Satomi, Yokohama; Yutaka Koizumi, Kawasaki; Isao Nakamura, Tokyo; Yasuhiro Tabata, Kawasaki; Tamaki Kaneko, Fujisawa, all of Japan

[73] Assignee: Ricoh Company, Ltd., Japan

[21] Appl. No.: 868,442

[22] Filed: Jan. 10, 1978

[30] Foreign Application Priority Data

| | | | |
|---|---|---|---|
| Jan. 11, 1977 | [JP] | Japan | 52/1644 |
| Jan. 31, 1977 | [JP] | Japan | 52/9479 |
| Mar. 17, 1977 | [JP] | Japan | 52/29457 |
| Mar. 22, 1977 | [JP] | Japan | 52/31360 |

[51] Int. Cl.[2] ..... G03G 15/00

[52] U.S. Cl. ..... 355/14 SH; 271/3.1; 271/4; 355/24; 355/26

[58] Field of Search ..... 355/23, 25, 26, 24, 355/3 R, 14, 8; 271/4, 3.1

[56] References Cited

U.S. PATENT DOCUMENTS

| | | | |
|---|---|---|---|
| 3,700,231 | 10/1972 | Aasen et al. | 271/65 X |
| 3,840,222 | 10/1974 | Fowlie | 271/4 |
| 3,980,406 | 9/1976 | Lang | 355/24 |
| 3,999,852 | 12/1976 | Katayama et al. | 355/26 |
| 4,023,791 | 5/1977 | Hori et al. | 271/4 X |
| 4,050,805 | 9/1977 | Hage | 355/24 X |
| 4,062,533 | 12/1977 | Greenberg et al. | 271/4 X |
| 4,099,150 | 7/1978 | Connin | 355/23 X |

*Primary Examiner*—R. L. Moses

*Attorney, Agent, or Firm*—McGlew and Tuttle

[57] ABSTRACT

A duplex copying machine has an auto document feeder and is capable of duplex copying from originals having images on one side, originals having images on both sides and combinations of the aforementioned two types. In a preferred embodiment of the duplex copying machine, whether an original has images on one side only or on both sides is detected so as to obtain a duplex copy from a duplex original and a one-side copy from a one-side original.

14 Claims, 14 Drawing Figures

DUPLEX COPYING MACHINE

BACKGROUND OF THE INVENTION

The present invention relates to a duplex copying machine, and more specifically to a duplex copying machine having an auto document feeder, which is capable of making one or more sets of duplex copies automatically in the case of sheet type originals regardless of the types of originals to be reproduced, such as originals having images on one side, originals having images on both sides and the combinations of the aforementioned two types.

The conventional method of making a duplex copy comprises the following steps. An original is placed on a duplex copying machine and an image of the original is formed on the first side of a copy sheet by conventional techniques, and after the original is turned over or it is replaced with another original, another image is likewise formed on the second side of the copy sheet. This is not always speedy.

Recently, particularly with respect to sheet type originals, there is a great demand for increasing the duplex copying speeds although there are various kinds of originals in the sheet type originals, such as an original having images on one side, an original having images on both sides and their combinations. Furthermore, in the case of the sheet type originals, when a large number of duplex copies are made, it is critical how to make copies in the order of the pages speedily, without necessitating the resetting of copies afterwards.

SUMMARY OF THE INVENTION

It is therefore a primary object of this invention to provide a duplex copying machine capable of duplex copying speedily from sheet type originals.

Another object of this invention is to provide a duplex copying machine capable of performing duplex copying without making a useless blank copy when the total of the image sides to be reproduced is an odd number.

A further object of this invention is to provide means for detecting whether an original is a one-side original or a duplex original to determine a copying mode in accordance with such detection whereby a duplex copy is obtained from a duplex original and a one-side copy is obtained from a single side original.

In one embodiment of a duplex copying machine of the present invention, an auto document feeder having an exposure station is attached to a conventional duplex copying machine. In this embodiment, it is most convenient to obtain duplex copies automatically from one-side originals. By stacking such originals in the order of the pages with the respective image sides down on an original document input tray, duplex copies are obtained in the order of the pages, and the originals are also recovered in the order of the pages.

In another embodiment of the duplex copying machine of the present invention, in order to obtain two or more sets of duplex copies from one set of one-side originals, an auto document feeder is mounted on a contact glass of the conventional duplex copying machine so that each original is held on the contact glass until a required repetition of exposure is finished.

In a further embodiment of the present invention, an auto document feeder is detachably mounted on the contact glass so that a book or bound material can be copied by the conventional method as well.

In a further embodiment of the present invention, an auto document feeder is designed so as to be rotatable about a shaft disposed at one end of the auto document feeder, so that by raising the other end of the feeder, a book or bound material can be copied on the contact glass by the conventional method.

In a further embodiment of the present invention, a secondary document input tray, and a swingable guide for guiding selectively each original document sheet into the original document output tray or into the secondary document input tray, are attached to the auto document feeder, whereby duplex copies can be obtained easily from both one-side originals and duplex side originals.

In a further embodiment of the present invention, means for indicating whether the total number of image sides of originals to be reproduced is odd or even is incorporated and the swingable copy sheet guide member is caused to operate so as to perform duplex copying without making a useless blank copy when the total of the image sides is an odd number.

In a further embodiment of the present invention, means for detecting whether an original is a one-side original or a duplex original and a control apparatus for determining a copying mode in accordance with such detection are incorporated.

DESCRIPTION OF THE PREFERRED EMBODIMENTS

Figure 1:
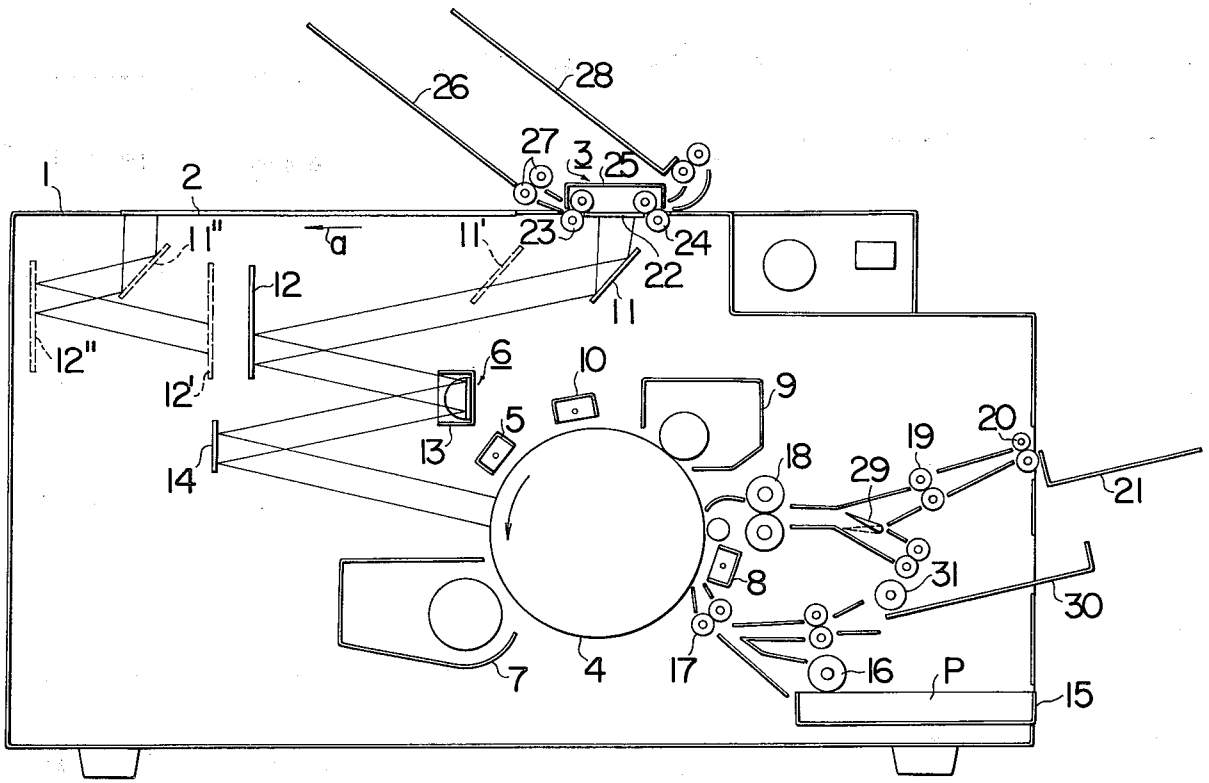
FIG. 1 is a schematic sectional side elevation of an embodiment of a duplex copying machine according to the present invention.

Referring now to the drawings, there is shown in FIG. 1 a duplex copying machine 1 of the type used with the present invention. On the upper portion of the duplex copying machine 1 are mounted a contact glass 2 for placing an original document thereon and an auto document feeder 3. The contact glass 2 is used when duplex copies are made from books or bound materials. Inside the copying machine is incorporated a photoconductive drum 4 which is rotated at a predetermined constant speed in the direction of the arrow in the figure, and arranged around the photoconductive drum 4 are a charging apparatus 5, an exposure apparatus 6, a development apparatus 7, an image transfer appratus 8, a cleaning apparatus 9 and a quenching apparatus 10. The exposure apparatus 6 consists of a first movable mirror 11, a second movable mirror 12, an in-mirror lens 13 and a third stationary mirror 14.

In the sheet mode copying, the first movable mirror 1 and the second movable mirror 12 are located stationarily in the respective positions shown by solid line. In this case, an exposure position is almost at the same level as that of the contact glass 2 and is located outside the range of the contact glass 2 in the direction of the respective starting positions 11', 12' of the first and second movable mirrors 11, 12 in the case of a book mode copying.

At the exposure position there is formed a slit exposure station and two pairs of document transport rollers 23, 24 are disposed on opposite sides of the slit exposure station. The lower rollers of the respective document transport rollers 23, 24 are disposed so as to project slightly out of the upper surface of the duplex copying machine 1 and are driven by appropriate driving means. The upper counterpart rollers of the document rollers 23, 24 are disposed so as to follow the lower driving rollers under the force of gravity of the upper rollers or under the force of an appropriate pressure created by spring means (not shown) and are pivotally mounted on an openable or detachable frame 25.

A stack of original document sheets are placed on an original document input tray 26 with the sides to be copied and, from the stack of original document sheets, the document sheets are separated and transported individually in the direction of the slit exposure station by separating and feeding rollers 27.

The arrival of each original document sheet is detected by sheet document detecting means (not shown) disposed in the space between the separating and feeding rollers 27 and the document transport rollers 23, whereby actuation of a series of the necessary copying steps, such as charging and exposure, are controlled.

The original document sheet thus transported by the separating and feeding rollers 27 is caused to pass through the slit exposure station where it is exposed, and after being reversed one time, it is discharged to an original document output tray 28 and stacked there with the exposed side up.

The auto document feeder 3 is used exclusively in the sheet mode copying since original document sheets to be copied can be fed successively into the auto document feeder 3 so that copying efficiency can be raised considerably and, at the same time, it is possible to copy document sheets two times as large as the documents that can be copied on the contact glass 2.

Figure 2:
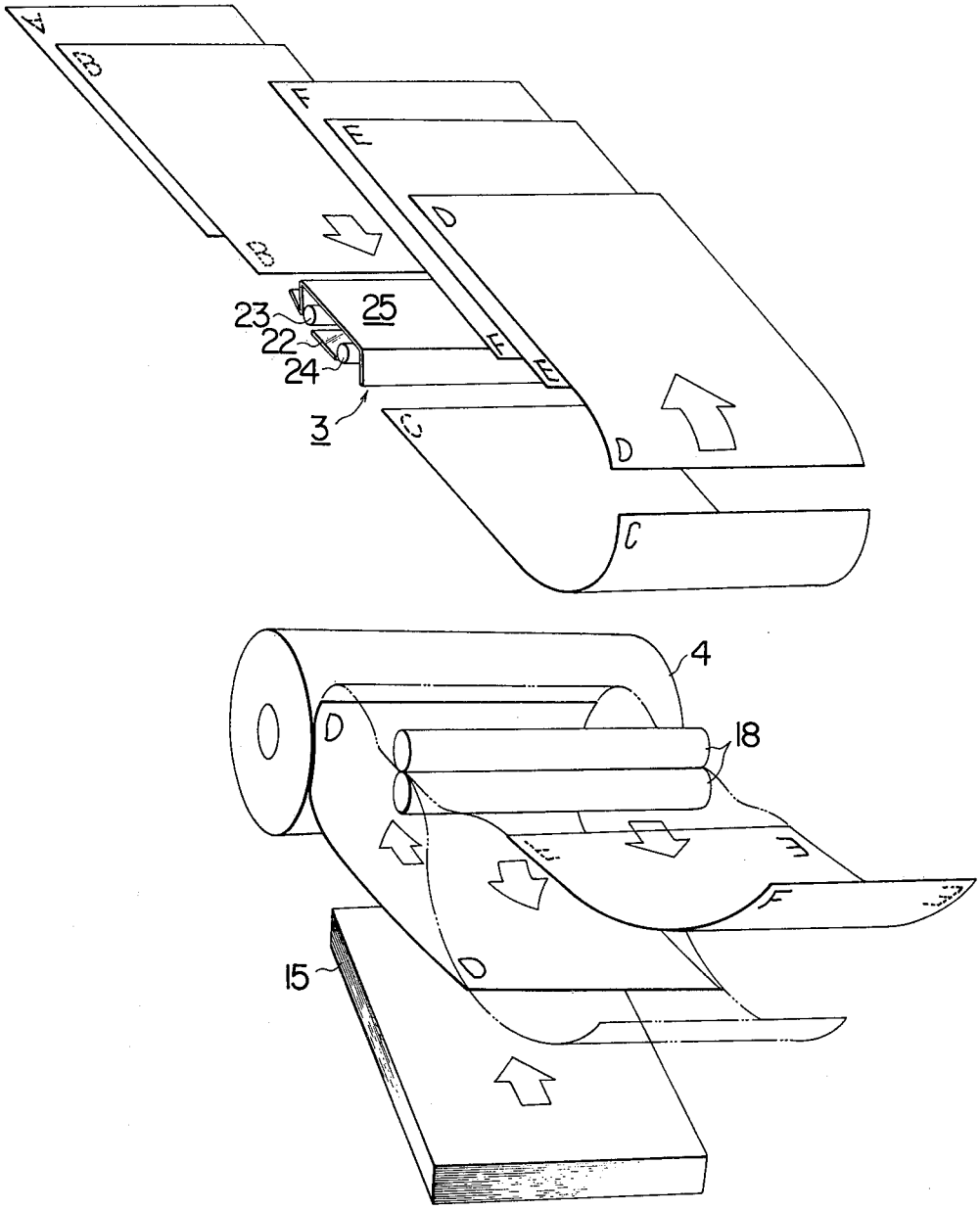
FIG. 2 is a schematic perspective illustration showing the movement of original document sheet and that of copy sheets in the embodiment of FIG. 1.

In the duplex sheet mode copying, and particularly in the case where original document sheets have images on one side thereof only, original document sheets, for example, six sheets A to F, as shown in FIG. 2, are stacked on the original document input tray 26 in the order of the successive pages (A to F from the bottom to the top) with the respective image sides down and a sequence control circuit of the duplex copying machine is set selectively so as to obtain duplex copies, with the respective two documents, A and B documents, C and D documents, . . . being copied on the respective duplex copies, i.e., Nth document is copied on one side of a duplex copy and (n+1)th document on the other side.

First of all, the top document sheet F is separated from a stack of such original document sheets on the original input tray 26 and fed into the slit exposure station. In accordance with such copying step of the original document sheet F, a copy sheet is fed from a primary tray 15 by the action of a paper feed roller 16 into an image transfer station so that a toner image corresponding to an image of the original document sheet F is transferred to the copy sheet and, after passing through a fixing station 18, it is guided by a swingable guide 29 temporarily into a secondary tray 30 with the first side, having the transferred image, up.

The original document sheet F, having passed through the slit exposure station, is discharged to the original document output tray 28 with the image side up.

When the copying of the original document sheet F has been finished, an original document E is then separated and fed into the slit exposure station by the separating and feeding rollers 27. At this moment, a paper feed roller 16 for use with the primary tray 15 is made inoperative, but a paper feed roller 31 for use with the secondary tray 30 is operated so that the copy sheet having had the image transferred from the original document sheet F on the first page thereof is fed towards the photoconductive drum 4. This copy sheet is transported so that the second side thereof is brought into contact with the drum 4. As a result, a toner image corresponding to an image of the original document sheet E is transferred to the second side of the copy sheet. This toner image is also fixed by the fixing station 18. In this case, since the swingable guide 29 has been switched to the position shown by dotted lines, the copy sheet is discharged to a copy output tray 21 with the second side thereof up.

An original document D is then separated and fed into the same manner as mentioned above. Hereafter the same copying process is repeated.

Referring to FIG. 1, in the case of the conventional "one side" copying mode, the swingable guide 29 is switched to a position shown by dotted line by conventional switching techniques, so that copies are stacked on a copy output tray 21. However, in the case of duplex copying, the guide 29 is controlled to switch its position from the dotted line position to the dotted line position and from the dotted line position to the solid line position with each passage of a copy sheet through the image transfer station.

The mechanism of such swingable guide is well known as is disclosed, for example, in U.S. Pat. No. 3,980,406.

In the present embodiment, in the case where the total number of original document sheet is even, duplex copying can be made automatically. However, when the total number is odd, a final copy has to be taken out of the secondary tray 30 or the swingable guide 29 has to be switched manually, preferably automatically, to the dotted line position in advance so that the final copy can be discharged to the copy output tray 21.

When a plurality of duplex copy sets are made from one set of original document sheets having images on the respective one sides thereof, such a set of the original document sheets discharged to the original document output tray 28 is turned upside down and placed on the original document input tray 26 again so that the top sheet (i.e., the first page) of the original document sheets is turned down, and the same procedure as mentioned above is repeated as required.

Figure 3:
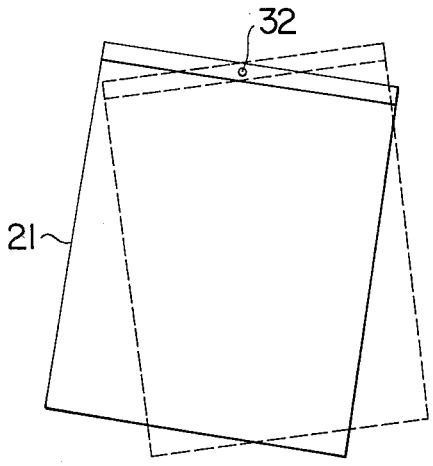
FIG. 3 is a schematic plan view of an embodiment of a copy paper output tray that can be used in a duplex copying machine according to the invention.

Another type copy paper output tray 21 is designed so as to be rotatable about a pivot 32 as shown in FIG. 3. This design is convenient to prepare a plurality of duplex copy sets since the position of the copy paper output tray 21 can be changed alternatively, for instance, from the solid line position to the dash line position and from the dash line position to the solid line position with each set of the duplex copies, thus each set of the duplex copies can be differentiated quite easily. As to the copy paper output tray 21, many other varieties may be possible, such as trays movable backwards and forwards, or to the left and right, in a parallel direction.

When a plurality of duplex copy sheets are made from one set of original document sheets, each original document sheet has to be passed through the auto document feeder 3 a required number of times. However, this is not desirable in view of the protection of original document sheets since there is a danger that they may be scratched or folded in the corners or wrinkled due to paper jamming.

Figure 4:
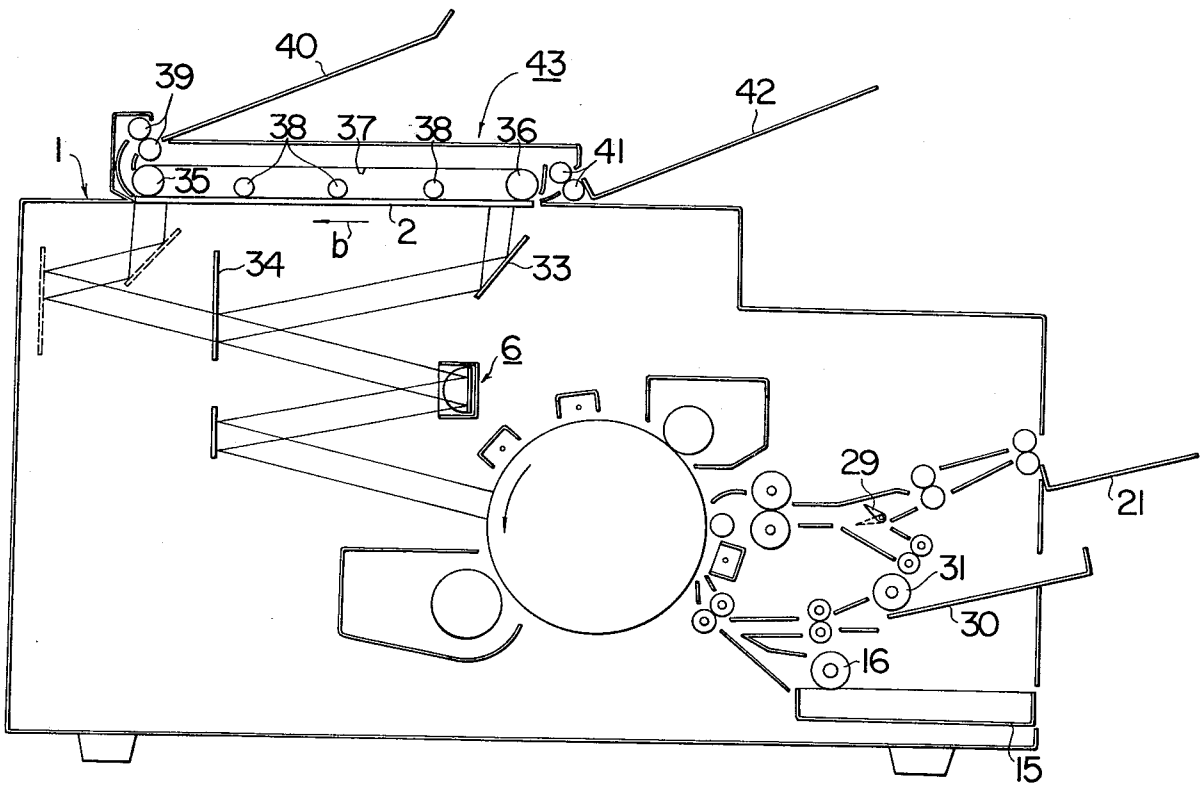
FIG. 4 is a schematic sectional side elevation of another embodiment of a duplex copying machine according to the invention.

FIG. 4 shows another embodiment of a duplex copying machine of the present invention, which allows each original document sheet to be positioned stationarily on the contact glass 2 for a certain period of time so that each original document sheet is scanned by an optical slit exposure system a required number of times when a plurality of the same duplex copy sets are desired.

In FIG. 4, the same reference numbers are utilized with respect to the elements having the same construction and action as those of the elements in FIG. 1, and detailed explanation of the action of each element in FIG. 4 is not repeated here.

Referring now to FIG. 4, the exposure apparatus 6 comprising a slit exposure system is normally located in a position indicated by solid line. A first movable mirror 33 and a second movable mirror 34 move at a $1:\frac{1}{2}$ speed ratio, respectively, in a direction parallel to the contact glass 2 as indicated by an arrow b.

When both mirrors 33, 34 have advanced up to the respective positions indicated by dotted lines, they return to their respective home positions.

One or more endless belts 37 connect a pair of rollers 35, 36 so as to cover the whole area of the contact glass 2. The endless belts 37, white in color, transport each original document sheet onto the contact glass 2 at a predetermined constant speed. Auxiliary rollers 38, which help the transport of each original document sheet, are engaged with the endless belts 37 so that the endless belts 37 are brought into close contact with each original document sheet under the force of gravity of the auxiliary rollers 38.

Near the lower end of an original document input tray 40, original document feed rollers 39 are so arranged to guide original document sheets individually into the nip formed between the belts 37 and the contact glass 2.

Original document sheets are stacked on the original document input tray 40 with the first side up in the order of the successive pages of the document sheets. Original document A with the first side up is transported up to a reference line at the right end of the contact glass 2 where it is stopped for a predetermined period of time and the leading edge of the sheet A is caused to correspond with the reference line, and at the same time, or after a predetermined period of time, exposure scanning is performed by the exposure apparatus 6 a required number of times. Meanwhile, in accordance with the scanning of the exposure apparatus 6, the same number of copy sheets as that of the exposure scanning are fed individually by a copy sheet feed roller 16 from the primary tray 15, thus the same number of copy sheets having had an image of the original document sheet A on one side thereof are stacked on a secondary tray 30. After the exposure of the original document sheet A, it is transported again to the right by the rotation of the endless belts 37 and is then discharged by original document sheet output rollers 41 to an original document output tray 42 with the image side down.

Then a second original sheet B is likewise fed into the exposure station where it is reversed one time, where the document sheet B is exposed the same number of times as in the case of the document sheet A. At this step, copy sheets are not fed from the primary tray 15, but the copy sheets stacked on the secondary tray are fed individually by a copy sheet feed roller 31 into the image transfer station. At this time, the swingable guide 29 is switched to a position indicated by dotted lines. Thus, copy sheets having images on both sides thereof are discharged to a copy output tray 21. On the copy output tray 21 are stacked copy papers with the respective image sides down, which correspond to an image of the first original document sheet A, and thereafter the odd number pages, such as 1st, 3rd, . . . are likewise down. Since the copy sheets are stacked in the order of successive pages, the sorting of the copy sheets is very simple.

The original document sheets are also stacked on the original document output tray 42 in the order of successive pages with an image side of each page down.

When duplex copying is made from books or bound materials by use of the duplex copying machine in FIG. 4, the auto document feeder 43 is rotated about the roller 35 and a book or bound material is placed on the contact glass 2, thus duplex copying is performed.

In the case where only one set of duplex copies is required, it is better not to stop each original document sheet, in view of the increase of copying efficiency. In this case, the exposure apparatus 6 is located stationarily in its home position shown by solid lines and each original sheet document is moved continuously at a predetermined speed, thus duplex copying is made.

Figure 5:
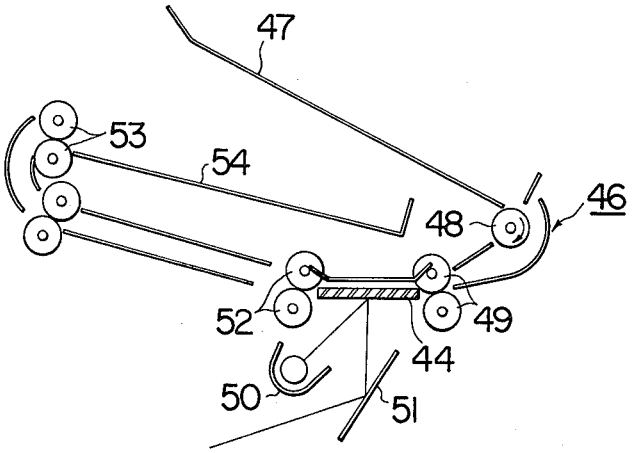
FIG. 5 is a schematic sectional side elevation of one preferred embodiment of an auto document feeder that can be employed in the invention.

FIG. 5 shows another auto document feeder 46 which can be employed in the duplex copying machine of the present invention. In the figure, reference number 44 indicates an exposure window for exclusive use with original document sheets.

On an original document input tray 47, original document sheets have images on one side thereof are stacked in the order of successive pages, the first page thereof being on the top and its image side up.

The original document sheets are fed individually from such a stack of document sheets in the order opposite to the successive pages, i.e., starting with the downmost page, by an original document sheet feed roller 48. The thus fed original document sheet is reversed one time and is then caused to pass over the exposure window 44 by first feed rollers 49 so that it is exposed by optical means, such as an illumination apparatus 50 and a reflector 51.

The exposed original document sheet is transported by second feed rollers 52 and original document sheet discharge rollers 53, and after being reversed one time, it is discharged to an original document output tray 54 with an image side up. Since the original document sheets are discharged in the order opposite to the successive pages, the document sheets are stacked on the tray 54 in the order of the successive pages with the respective image side up.

Meanwhile, copy sheets are moved in the same manner as mentioned in the explanation of FIG. 1.

Since the original document sheets are stacked on the original output tray 54 in the same manner as on the original document input tray 47, the original document sheets can be used in repetition by simply replacing them from the original document output tray 54 to the original document input tray 47.

In the case where the original document input tray 47 and the original document output tray 54 are made so as to be interchangeable, it is possible to mount the original document output tray 54 detachably so that, after each exposure of a set of original document sheets, the original document input tray 47 can be replaced with the original document output tray 54 without dislodging the set of the document sheets from the output tray 54. The auto document feeder 43 can be used interchangeably.

Figure 6:
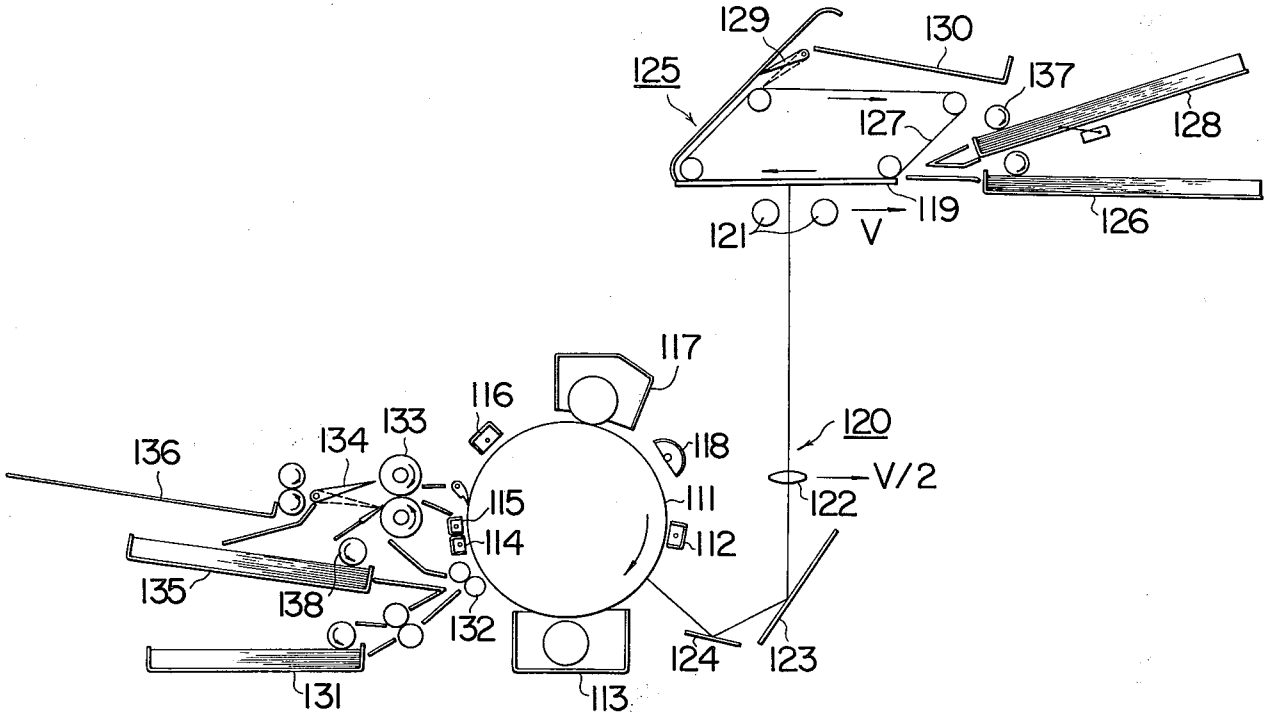
FIG. 6 is a schematic sectional side elevation of a further embodiment of a duplex copying machine according to the present invention.

FIG. 6 shows a further embodiment of a duplex copying machine of the present invention. In the figure, reference number 111 indicates a photoconductive drum. Arranged around the photoconductive drum 111 are a charging apparatus 112, a development apparatus 113, an image transfer apparatus 114, a paper pick-off apparatus 115, a quenching charger 116, a cleaning apparatus 117 and a quenching lamp 118.

A contact glass 119 for placing an original document thereon is mounted on the upper portion of the duplex copying apparatus. The original document placed on the contact glass 119 is scanned by an optical slit exposure system 120 which is located in the space between the contact glass 119 and the photoconductive drum 111. The optical slit exposure system 120 is located right under the contact glass 119 and consists of a scanning lamp 121 which is moved in a direction parallel with the contact glass 119 as indicated by an arrow at the same speed as that of the photoconductive drum 111, a lens 122 which is moved in the same direction as the scanning lamp 121 at half the speed of the scanning lamp 121, and two fixed reflecting mirrors 123, 124 disposed behind the lens 122.

Upon the contact glass 119 is detachably or rotatably located an auto document feeder 125. The auto document feeder 125 comprises a primary document sheet feed cassette 126, conveyor belts 127, a secondary document sheet feed cassette 128, a swingable guide 129, and a document sheet output tray 130.

On the other hand, copy paper conveyor apparatus comprises a primary paper feed cassette 131, register rollers 132, image fixing rollers 133, a swingable guide 134, a secondary paper feed cassette 135 and a paper output tray 136.

The procedure of obtaining duplex copies from duplex original document sheets (i.e., original sheets having images on both sides thereof) is as follows. Duplex original document sheets are stacked on the primary document sheet feed cassette 126 in the order of the successive pages with the first side down. Sheet feed is started with the top sheet of a stack of such original document sheets in the primary document sheet feed cassette 126. For a better understanding, suppose that duplex copies are obtained from two original sheets $O_1$, $O_2$. The original sheet $O_1$ has side 1 and side 2, and the original sheet $O_2$ has side 3 and side 4. Firstly, original sheet $O_2$ is fed from the primary document sheet feed cassette 126 and transported to a predetermined exposure position by the conveyor belts 127, where the original sheet $O_2$ is stopped with side 3 down.

The arrival of the original sheet $O_2$ at the exposure position is detected directly or indirectly by conventional techniques, and the original sheet $O_2$ is scanned by the optical slit exposure system 120. A latent electrostatic image corresponding to an image of page 3 is formed on the photoconductive drum 111.

After the latent electrostatic image formed on the photoconductive drum 111 has been developed, a transfer paper $P_1$ is fed from the primary paper feed cassette 131, synchronizing with the rotation of the photoconductive drum 111 so that a toner image corresponding to the image of side 3 of the original sheet $O_2$ is transferred to the first side of the transfer paper $P_1$. The transfer paper $P_1$ having the transferred image on its first side is caused to pass through the image fixing rollers 133 and is then stacked on the secondary paper feed cassette 135 with the image side up. At this time, the swingable guide 134 is switched to a solid line position.

After the exposure of side 3 of the original sheet $O_2$, the original sheet $O_2$ is again transported and discharged to the secondary document sheet feed cassette 128 with side 3 up. At this time, a sheet feed roller 137 and pick-off nails (not shown) are retracted from the secondary document sheet feed cassette 128 so that the discharge of the original sheet $O_2$ is not hindered by them.

The transfer paper $P_2$ is discharged to the paper output tray 136 with the first side down after it has been caused to pass through the image fixing rollers 133. Meantime, after exposure, the original sheet $O_1$ is discharged to the document sheet output tray 130 and stacked there with side 1 down. Hereafter the same procedure is repeated and an image corresponding to side 4 of the original sheet $O_2$ is formed on the fourth side of the transfer paper $P_1$, and the transfer paper $P_1$ is discharged to the paper output tray 136 with the fourth side up. On the other hand, after exposure, the original sheet $O_2$ is stacked on the original sheet $O_1$, with side 3 down.

In a predetermined period of time after it has been detected that no original sheet is left in the secondary sheet feed cassette 128, or after the detection of a final original sheet by detecting means (not shown) disposed immediately before the document sheet output tray 130, a series of duplex copying steps are finished.

The used original sheets are stacked on the document sheet output tray 130 in the order of the successive pages with the first sides down.

The transfer papers having had images on both sides are also stacked on the paper output tray 136 in the order of the successive pages with the first sides down. It must be noted here that original document sheets have to be fed in a lateral direction. For example, if an A4 (210×297 mm) size original sheet is fed in a longitudinal direction for making a duplex copy, images on one side of a copy paper are copied up side down.

In order to obtain multiple sets of duplex copies from one set of duplex original sheets, when each original sheet is placed on the contact glass 119, exposure of each sheet is repeated a required number of times by the optical slit exposure system.

When the exposure of the original sheet $O_2$ has been finished and the discharge of the sheet $O_2$ has begun, the next original sheet $O_1$ is fed from the primary document sheet feed cassette 126. By the same procedure as mentioned above, a toner image corresponding to an image of side 1 of the original sheet $O_1$ is formed on the photoconductive drum 111. In accordance with the exposure of the original sheet $O_1$, a transfer paper $P_2$ is fed from the primary paper feed cassette 131 and a toner image corresponding to an image of side 1 of the original sheet $O_1$ is transferred to the first side of the transfer paper $P_2$, and the transfer paper $P_2$ is transferred to the secondary paper feed cassette 135 and is stacked there with its first side up. Meanwhile, the original sheet $O_1$ is transported to the secondary document sheet feed cassette 128 and stacked on the original sheet $O_2$ with side 1 of the sheet $O_1$ up.

Residue detection means or a counter which has been preset in advance detects that no original sheet is left in the primary document sheet feed cassette 126, whereby the original sheet feeding of the auto document feeder 125 is switched to the sheet feeding from the secondary document sheet feed cassette 128, and at the same time, swingable guides 129, 134 are switched from a solid line position to a dotted line position, and a paper feed roller 138 disposed above the secondary paper feed cassette 135 is moved down to a position for paper feeding.

By the sheet feed roller 137, the top sheet $O_1$ is fed from the secondary document sheet feed cassette 128 to the exposure station. Since the original sheet $O_1$ is fed with side 1 up, it is placed on the contact glass 119 with side 2 down. Likewise, the transfer paper $P_2$ is fed and an image corresponding to an image of side 1 is formed on the second side of the transfer paper $P_2$.

Accordingly, the same number of transfer papers having the same image are stacked on the secondary paper feed cassette 135. Hereafter the above-mentioned duplex copying procedure is repeated.

In order to obtain duplex copies from original sheets having images on one side thereof, such original sheets are stacked on the primary document sheet feed cassette 126 or on the secondary document sheet feed cassette 128, with the respective image sides down, and are individually fed in the order opposite to the successive pages.

In this case, side 1 of the first original sheet and side 2 of the second original sheet have to be copied on opposite sides of a transfer paper. Thus, on the first side of a transfer paper fed from the primary paper feed cassette 131 is formed an image corresponding to an image of a final original sheet. The transfer paper is stacked on the secondary paper feed cassette 135. When the next original sheet is placed in the exposure station and exposed, the transfer paper having images on one side thereof is fed from the secondary paper feed cassette 135 and an image corresponding to an image of the above-mentioned second original sheet is formed on the other side of the transfer paper. Then, the transfer paper is discharged to the paper output tray 136. Hereafter the same procedure is repeated. As a result, the used original sheets are stacked on the document sheet output tray 130 in the order of the successive pages with the first side up, and the transfer paper are likewise stacked on the paper output tray 136 in the order of the successive pages with the first side up.

In order to obtain one-side copies from a one-side original, namely in the case of the conventional copying mode, the swingable guides 129, 134 are switched to the respective dotted line positions. Original sheets are stacked on the primary document sheet feed cassette 126 or on the secondary document sheet feed cassette 128 with the respective image sides down.

Starting with the top original sheet, original sheets are fed individually. In accordance with the feeding of such original sheets, transfer papers are also fed, and after passing through the image fixing rollers, they are discharged to the paper output tray 136 with the respective image sides up.

In the case of this copying mode, if transfer papers of two different sizes are held in the primary paper feed cassette 131 and the secondary paper feed cassette 135, respectively, by detecting the size of each original sheet by an appropriate detecting means, it becomes possible to feed transfer papers of a proper size from the cassette 131 or the cassette 135.

In the case where multiple copies of a single size are made, transfer papers of the same size are held in both cassettes 131, 135. This will permit continuous copying in case the transfer papers in one cassette are used up by connecting the paper feed route with either of the two cassettes where transfer papers are still left by selecting a paper feed route from the cassette 131 or that from the cassette 135.

In FIG. 6, when copies are made from a book or bound material, the auto document feeder 125 is retracted from the contact glass 119.

Figure 7:
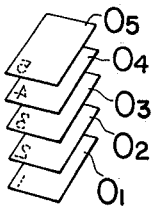
FIG. 7 is a perspective illustration showing a stack of one-side originals whose total number is odd.
Figure 8:
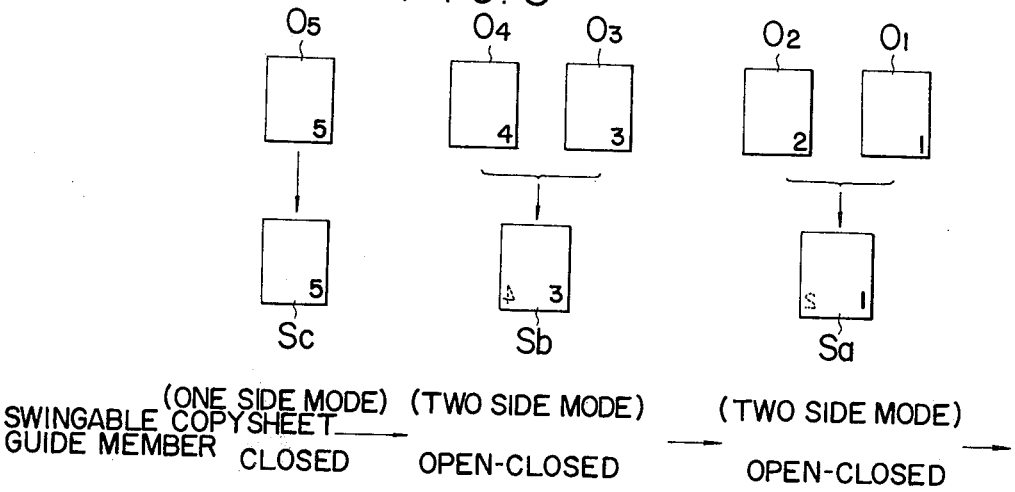
FIG. 8 is a schematic illustration showing the relationship between a duplex or one-side copy mode and an opening and closing operation of a swingable copy sheet guide member when the total number of one-side originals is odd.

Referring to FIG. 8, when duplex copies are made from five original document sheets ($O_1$, $O_2$, . . . $O_5$) having images on one side thereof, those original document sheets are stacked on the original document input tray 26 (refer to FIG. 1) as shown in FIG. 7. Thus, original document sheet $O_5$ is fed first. At this moment, the swingable guide 29 is set at the dotted line position (hereafter called "open position"). Accordingly, a transfer paper fed from the primary tray 15 is directly guided into the copy output tray 21. Then the original document sheets $O_4$, $O_3$, $O_2$ and $O_1$ are copied by the duplex copying mode in which the swingable guide 29 is switched from "closed position" to "open position" or from "open position" to "closed position" with the copying of each side.

Figure 9:
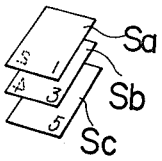
FIG. 9 is a perspective illustration showing how to stack the copy sheets in FIG. 8.

Finally, three duplex copies are stacked on the original document output tray 28 as shown in FIG. 9.

Figure 10:
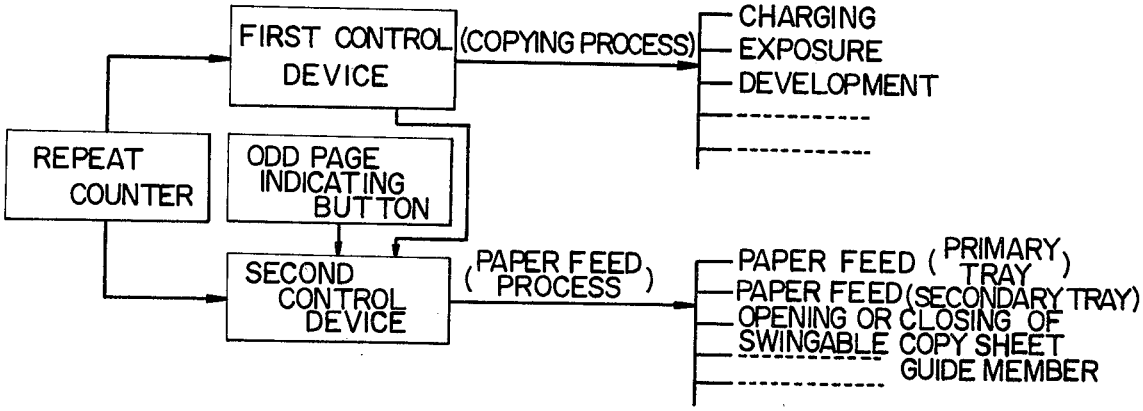
FIG. 10 is a schematic block diagram of a control system of one embodiment of a duplex copying machine according to the invention.

FIG. 10 shows a block diagram indicating a control system of the above-mentioned embodiment of the present invention. In this control system, two control devices, namely the first control device comprising electric circuits and operation mechanisms, and the second control device for controlling a paper feed system, are correlated with a repeat counter or an odd page indicating button, whereby a sequence control of the copying process and paper feed process is performed. The paper feed system mentioned above includes the paper feed roller 16 for use with the primary tray 15, the paper feed roller 31 for use with the secondary tray 30, and the swingable guide 29.

The proper timing of the rotation start of both paper feed rollers 16, 31 and the opening and closing of the swingable guide 29 are controlled by the second control device for controlling the paper feed system.

Figure 11:
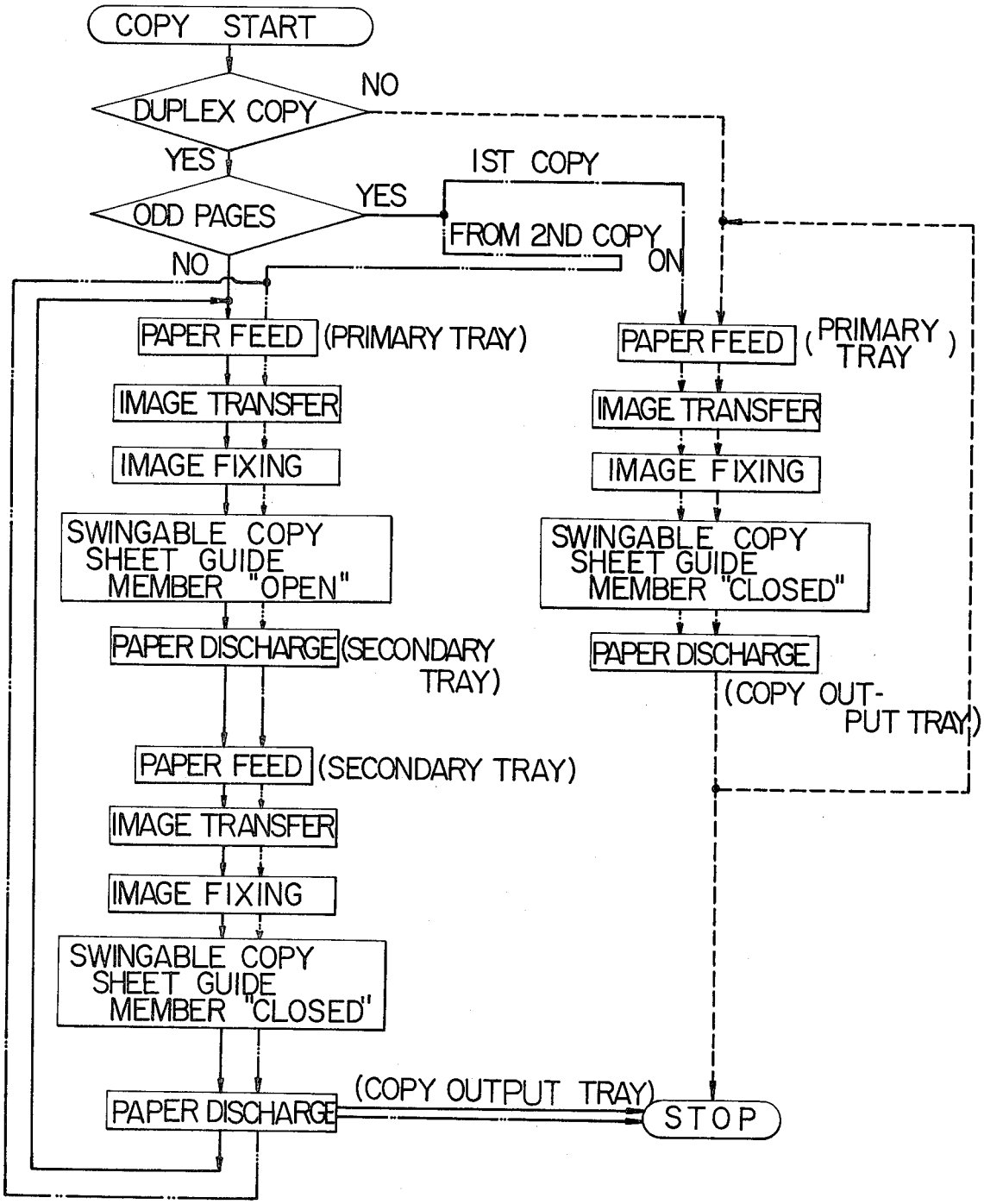
FIG. 11 is a flow chart showing the flow of various copy processes depending upon the copying modes.

FIG. 11 shows systematically the respective flows of copying process in accordance with various the copying modes. Referring to FIG. 11 together with FIG. 1, when only the conventional "one side" copying is performed, its copying process is caused to follow the steps indicated by dash lines, wherein the swingable guide 29 is kept open and the one-side copying cycle is repeated.

When duplex copying is made from an odd number of original document sheets having images on one side thereof as in the case of FIG. 8, with respect to the first copy, the copying process is caused to follow the steps indicated by long and short dash lines and, with respect to the second copy and thereafter, the copying process is caused to follow the steps indicated by long and two short dash lines.

In the case where duplex copies are made from even number of original document sheets having images on both sides thereof, the copying process is caused to follow the steps indicated by solid lines.

Figure 12:
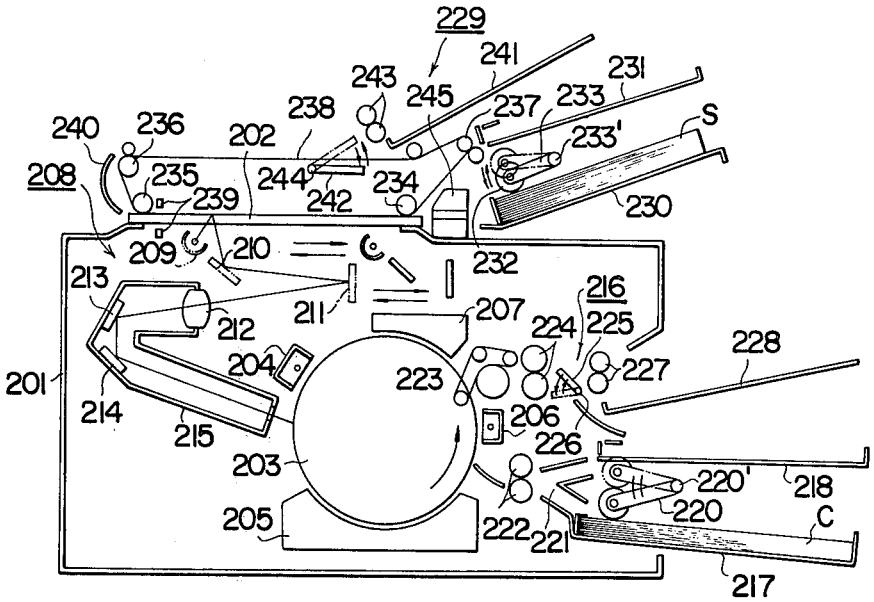
FIG. 12 is a schematic sectional side elevation of a further embodiment of a duplex copying machine according to the invention.

FIG. 12 shows a further embodiment of a duplex copying machine of the present invention. In this embodiment, since the inside of an outer casing 201 is substantially the same as that of the duplex copying machine in FIG. 1, detailed explanation about the parts of the inside is not repeated here.

Reference number 229 is an auto document feeder mounted on the upper portion of the outer casing 201. The auto document feeder 229 comprises a slanted original document input tray 230 capable of holding a number of original sheets which is disposed on one side of a contact glass 202, namely on the right side in the figure, and a secondary document input tray 231 which slants as the tray 230 does and which is disposed right above the tray 230. Between the original document input tray 230 and the secondary original document input tray 231 is disposed on original sheet feed roller 232 which is for use with both the trays 230, 231.

The original feed roller 232 is rotatably mounted on an arm 233 which is swingable about a shaft 233', so that the original sheet feed roller 232 is movable up and down between the original document input tray 230 and the secondary original document input tray 231. When the roller 232 is located in a lower position as indicated by the solid line, it separates original document sheets individually from a stack of original document sheets held in the tray 230, starting with a top sheet thereof, and transports them individually to the right hand end of the contact glass 202 in the figure. On the other hand, when the roller 232 is located in an upper position as indicated by dash lines, it separates original document sheets individually from a stack of original document sheets held in the tray 231, starting with a bottom sheet thereof, and transports them individually to the right hand end of the contact glass 202 in the figure. On the contact glass 202 are mounted endless conveyor belt 238 which connects four rollers 234, 235, 236, 237.

At least one roller out of the four rollers, for example, the roller 234 is driven so as to rotate clockwise in the figure by a motor (not shown), whereby the endless conveyor belt 238 is caused to run clockwise along the above-mentioned four rollers.

A portion of the conveyor belt 238 between the roller 234 and the roller 235, namely an under path portion of the conveyor belt 238, is in close contact with the contact glass 202 and conveys each original document sheet transported by the original sheet feed roller 232 from the right end of the contact glass 202 to a reference position on the contact glass 202 and, at the same time, brings each original document sheet into close contact with the contact glass 202.

In the case of this embodiment, the reference position on the contact glass 202 is determined by a photoelectric sensor 239 disposed near the left end of the contact glass 202.

The photoelectric sensor 239 may be constructed in combination of a light source element and a photosensitive electric element, such as a phototransistor which, are disposed so as to face each other, and are set apart by the contact glass 202. When an original document sheet has advanced between the two elements, the light emitted from the light source element is intercepted and light input to the photosensitive electric element is changed, whereby the relative position of each original document sheet on the contact glass 202 is detected.

When light input to the photosensitive electric element is changed by an original document sheet as mentioned above, the rotation of the roller 234 is stopped and accordingly the running of the conveyor belt 238 is stopped at the same time. It follows that the original document sheet is stopped at a position where the leading edge of the original sheet enters the photoelectric sensor 239. Such stop position of original document sheets is a reference position for exposure of original documents.

At the left end portion of the contact glass 202 is disposed a semicircular guide plate 240 which guides each original document sheet transported from the contact glass 202 by the conveyor belt 238 to an over path portion of the conveyor belt 238, namely to a position between the roller 236 and the roller 237.

Above the over path portion of the conveyor belt 238 is disposed a slanted original document output tray 241, which is designed so as to receive original document sheets which are conveyed to the over path portion of the conveyor belt 238 and then guided by a swingable guide 242 to a pair of original document output rollers 243 and discharged therefrom.

The swingable guide 242 is supported swingably by a shaft 244 and is swingable between the lower position where it is retracted below the conveyor belt 238 and the upper position indicated by dash lines where it crosses the conveyor belt 238. When it is set at the lower position, original document sheets are allowed to pass, but when it is at the upper position, original document sheets are guided into the pair of original document output rollers 243.

In the present embodiment, an original document detection apparatus 245 is mounted between the original document input tray 230 and the contact glass 202. This original document detection apparatus 245 is to detect whether an original document sheet transported from the original document input tray 230 to the contact glass 202 is a one-side original (i.e., original having images on one side) or a duplex original (i.e., original having images on both sides).

Figure 13:
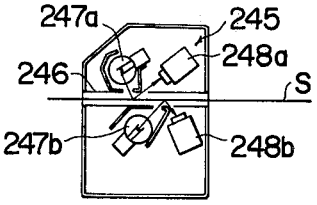
FIG. 13 is a schematic sectional side elevation of one preferred embodiment of an original document detection apparatus suitable for use with the embodiment of FIG. 12.

For example, as shown in FIG. 13, the original document detection apparatus comprises an original document passage route 246, light source elements 247*a*, 247*b* disposed above the route 246 and below the route 246, respectively, and photosensitive electric elements 248*a*, 248*b* which receive reflected light from the light source element 247*a* and from the light source element 247*b*, respectively.

The respective light inputs to the photosensitive electric elements 248*a*, 248*b* change in case the respective sides of an original document which face the respective electric elements 248*a*, 248*b* have images. Accordingly the respective electric outputs from the two elements 248*a*, 248*b* change.

In contrast with this, when there is no image on both sides of an original document, the above-mentioned respective electric outputs do not change substantially.

Electric signals generated at both photosensitive electric elements 248*a*, 248*b* are transmitted to a control apparatus.

Figure 14:
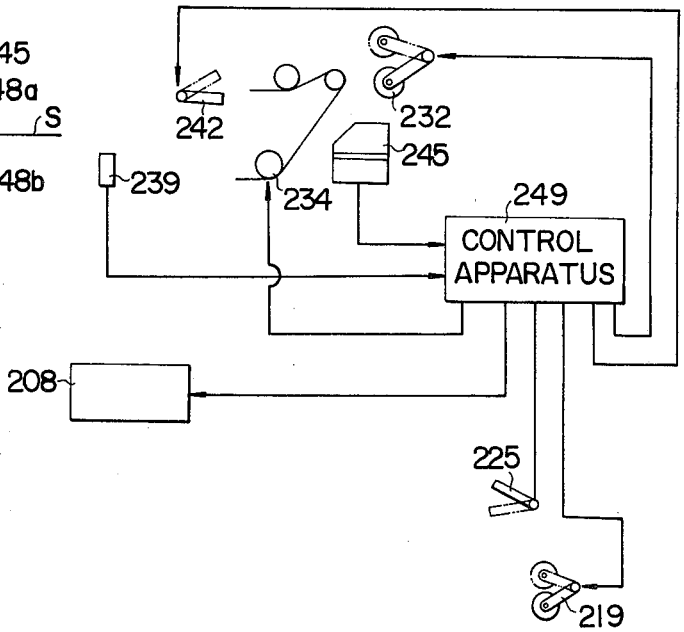
FIG. 14 is a block schematic diagram of an electric control system of the embodiment of FIG. 12.

FIG. 14 is a block diagram showing a control system of a duplex copying machine of the present invention, containing the above-mentioned control apparatus. In the figure, the control apparatus is indicated by reference number 249.

The control apparatus 249 is so constructed that it receives the respective electric signals produced by the photosensitive electric elements 248*a*, 248*b* of the original document detection apparatus 245 and by the sensor 239, and commands the paper feed rollers 219, 232, swingable guides 225, 242, a driving motor (not shown in the figure) for use with the roller 234 and an exposure apparatus 208 including light source circuits of a light source 209 to operate in accordance with the kinds of original documents and in a predetermined order, based on the commands given by ordinary processing circuits or sequence control circuits.

The procedure of the operation of this duplex copying machine is as follows. Original document sheets S to be reproduced are stacked on the original document input tray 230. Then, by turning on a starting switch (not shown), the copying machine is actuated, whereby each electric system of the copying apparatus of the machine is actuated.

A photoconductive drum 203, register rollers 222, copy paper pick-off belt 223, rollers of image fixing apparatus 224, the conveyor belt 238 and paper output rollers 227, 243 are driven and, at the same time, the paper feed roller 232 which has been standing by at the lower position begins to rotate, so that a top original sheet is separated from a stack of original document sheets on the original document input tray 230. The top original sheet is then caused to pass through the original document passage route 246 and, as the kind of the original document sheet is being detected, the sheet is transported to the left, sliding on the contact glass 202, by the conveyor belt 238 which has already been caused to run.

When the original document sheet has been completely taken out of the original document input tray 230, the rotation of the paper feed roller 232 is stopped and is caused to stand by for the next command at the lower position.

When the sensor 239 detects that the above-mentioned original document sheet has been transported up to the reference position on the contact glass 202, the conveyor belt 238 is stopped so that the original document sheet is stopped at the reference position for exposure on the contact glass 202.

By this time, the original document detection apparatus 245 has finished detecting the kind of the original document sheet and the control apparatus 249 has determined the necessary copy paper feed route and the next original document feed route. In other words, the control apparatus 249 has given a control command to the swingable guides 225, 242 and the copy paper feed roller 219 and the original sheet feed roller 232.

In the case where the original sheet is detected to be a duplex original, the original sheet feed roller 232 is moved to the upper position indicated by dash lines at this stage. Also the swingable guide 225 is moved to the upper position and the other swingable guide 242 is moved to the lower position or it is confirmed that those swingable guides 225, 242 have been moved to the above-mentioned positions, respectively. Also at the same time, a light source 209 is energized, and the light source 209, first movable mirror 210 and second movable mirror 211 are moved from the respective solid line positions to the respective positions indicated by long and two short dash lines so that the original document sheet placed on the contact glass 202 is optically scanned for exposure. When the light source 209 and the two mirrors 210, 211 have come to their respective positions indicated by long and two short dash lines, they return to their original positions, respectively so that they are caused to stand by for the next operation.

A light image obtained by such exposure scanning, corresponding to an image of the original document sheet, is projected on the surface of a photoconductive drum 203, which has been charged uniformly. Thus a latent electrostatic image is formed on the photoconductive durm 203.

Such a latent electrostatic image can be developed, for example, by a magnetic brush development apparatus 205.

Meanwhile, a top copy sheet is separated from a supply of copy sheets C, held in a primary tray 217, by the copy paper feed roller 219 and is transported into a copy paper guide route 221. The copy sheet is fed between an image transfer apparatus 206 and the surface of the photoconductive drum 203 by register rollers 222 in synchronism with the rotation of the photoconductive drum 203. Thus the copy paper is brought into close contact with the toner image bearing surface of the drum 203 and the toner image is electrostatically transferred from the photoconductive drum 203 to the copy paper by the image transfer apparatus 206. The copy having the toner image is stripped from the photoconductive drum 203 by the copy paper pick-off belt 223 and is then transported to an image fixing apparatus 224, where the toner image is substantially fixed permanently. Since the swingable guide 225 is moved to the upper position at this moment, the copy paper having an image on one side thereof is transported to a secondary tray 218 and placed there with the image side up.

The original document sheet which is placed on the contact glass 202 and whose down side has been exposed is conveyed to the left in the figure by the conveyor belt 238 which has begun to rotate clockwise in the figure upon the finishing of exposure.

The sheet is then guided by the guide plate 240 onto the over path portion of the conveyor belt 238 so that it is transported to the right in the figure.

By this moment, since the swingable guide 242 has been moved to the lower position as mentioned previously, the original document sheet is transported to the secondary original document input tray 231 up side down (i.e., with first exposed side up).

When the original document sheet is placed on the secondary original document input tray 231, as mentioned previously, the original sheet feed roller 232 which has been moved to the upper position has begun to rotate, so that the original document sheet, which has been placed on the secondary original document input tray 231, is again fed to the contact glass 202. This original document sheet is conveyed up to the reference exposure position on the contact glass 202 by the conveyor belt 238. When the sensor 239 detects that the original document sheet has come to the reference exposure position, the original sheet feed roller 232, which has been stopped after finishing the original document feed, is returned to the lower position so that it is caused to stand by for the next original document sheet feed from the original document input tray 230. At this moment, the swingable guide 225 is switched to the lower position and swingable guide 242 is switched to the upper position.

When the original document sheet is placed with its second side down and stopped at the reference exposure position, the exposure apparatus 208 comprising the light source 209, the first movable mirror 210, and the second movable mirror 211 is operated so that the original document is scanned for exposure by the exposure apparatus 208.

A light image obtained by the exposure scanning, corresponding to a second side image of the original document sheet, is projected on the surface of the photoconductive drum 203 and a latent electrostatic image is formed. The latent electrostatic image is developed by the development apparatus 205.

Also at this time, the copy sheet which has been placed on the second tray 218 is guided into the copy paper guide route 221 by the copy paper feed roller 219. From the guide route 221, the copy sheet is again fed between the surface of the photoconductive drum 203 and the image transfer apparatus 206, where the toner image is electrostatically transferred from the photoconductive drum 203 to the second side of the copy sheet. Thereafter it is transported into the image fixing apparatus 224. At this time, since the swingable guide 225 is switched to the lower position indicated by dash lines in the figure, the copy sheet is discharged to a copy output tray 228 by a pair of copy sheet output rollers 227 after the image fixing is finished, without being guided into the second tray 218. Thus a complex copy corresponding to the duplex original is obtained.

The original document sheet placed on the contact glass 202 is again conveyed to the over path portion of the conveyor belt 238 by the conveyor belt 238 and the guide plate 40 after the second exposure. At this time, since the swingable guide 242 is switched to the upper position as indicated by long and two short dash lines, the original document sheet is guided by the swingable guide 242 in the direction of the original document output rollers 243 and is discharged to the original document output tray 241.

In case an original document sheet which is fed to the contact glass 202 from the original document input tray 230 is a one-side original, the copy paper feed roller 219 and the original sheet feed roller 232 are switched to the respective lower positions, and the swingable guide 225 is at the lower position indicated by long and two short dash lines, while swingable guide 242 is at the upper position indicated by long and two short dash lines.

Therefore, after one exposure, the original document sheet is directly discharged to the original document output tray 241, and a copy sheet having an image on one side is also discharged to the copy output tray 228.

When a one-side original is fed to the exposure station with its image side up, all the apparatuses except the exposure apparatus 208 are operated in the same manner as in the case of the above-mentioned duplex copying.

In other words, the original sheet is transported onto the contact glass 202 and is then transported to the second original document input tray 231. It is transported from the tray 231 to the contact glass 202 with the image side down, whereby the exposure apparatus 208 is operated.

With respect to copy sheets, it will do to feed a copy sheet from the primary tray 217 to the photoconductive drum 203 at this time or to transport a copy sheet in advance to the secondary tray 218 without any image formation thereon in synchronism with the original sheet and then let the copy sheet go from the tray 218 to the photoconductive drum 203.

What is claimed is:

1. In a duplex copying machine of the type having a contact glass for placing an original document thereon, a photoconductive member, charging means for imposing a uniform electrostatic charge on the photoconductive member, exposure means for forming a latent electrostatic image corresponding to an image to be reproduced, developing means for bringing transferable toner into contact with the photoconductive member to render the latent electrostatic image a transferable toner image, transfer means for transferring the toner image from the photoconductive member to a copy sheet, image fixing means for affixing the toner image to the copy sheet, a primary tray for holding a supply of copy sheets, a secondary tray for holding one or more copy sheets having an image transferred from the photoconductive member to one side thereof, a copy output tray, copy paper transport means connecting the three trays, and a swingable guide member which selectively guides copy sheets into the secondary tray or into the copy output tray, the improvement comprising:

image side number indicating means for indicating whether the total number of image sides of original documents to be reproduced is odd or even, said swingable guide member guiding copy sheets to said secondary tray and said copy output tray alternatively in case the total number of image sides to be reproduced is indicated to be even by said image side number indicating means, and guiding the first copy sheet directly into said copy output tray after one-side copying in case the total number of image sides to be reproduced is indicated to be odd by said image side number indicating means, and thereafter guiding copy sheets to said secondary tray and said copy output tray alternatively.

2. In a duplex copying machine of the type having a contact glass for placing an original document thereon, a photoconductive member, charging means for imposing a uniform electrostatic charge on the photoconductive member, exposure means for forming a latent electrostatic image corresponding to an image to be reproduced, developing means for bringing transferable toner into contact with the photoconductive member to render the latent electrostatic image a transferable toner image, transfer means for transferring the toner image from the photoconductive member to a copy sheet, image fixing means for affixing the toner image to the copy sheet, a primary tray for holding a supply of copy sheets, a secondary tray for holding one or more copy sheets having an image transferred from the photoconductive member to one side thereof, a copy output tray, copy paper transport means connecting the three trays, and a swingable copy sheet guide member which selectively guides copy sheets into the secondary tray or into the copy output tray, the improvement comprising:

an auto document feeder comprising an original document input tray, original document transport means, a secondary original document input tray, a swingable original sheet guide member, and an original document output tray;

an original document detection apparatus operable to detect whether an original is a one-side original or a duplex original, and producing a different signal depending upon the kinds of originals; and a control apparatus determining a copy mode in accordance with a signal from said original document detection apparatus.

3. A duplex copying machine as in claim 2, wherein original sheets held in said secondary document input tray are individually discharged from the downmost portion of said secondary document input tray, and copy sheets held in said secondary tray are individually discharged from the downmost portion of said secondary tray.

4. A duplex copying machine as in claim 2, wherein said original document detection apparatus is located between said original document input tray and an exposure station for originals.

5. A duplex copying machine as in claim 2 wherein said original document detection apparatus comprises an original document passage route through which an original sheet can pass, and at least two sets of a light source element and a photosensitive electric element, the same number of the sets being disposed on each side of an original sheet to be detected.

6. In a duplex copying machine of the type having a first sheet feed apparatus capable of stacking a plurality of copy sheets thereon and feeding copy sheets to a photoconductor to form toner images on the respective first sides of the copy sheets, and a second sheet feed apparatus capable of receiving said copy sheets and feeding said copy sheets back to said photoconductor to form toner images on the respective second sides of said copy sheets, and a sheet outlet tray for receiving said copy sheets thereon after the copying process, and capable of a book mode operation which is attained by exposing an original on a contact glass adapted for receiving book originals thereon by use of a movable optical system, and capable of a sheet mode operation which is attained by advancing sheet originals on a long and narrow contact glass, which is spaced from said former mentioned contact glass, by use of a fixed optical system, the improvement comprising, in said sheet mode operation:

an original sheet feed apparatus capable of stacking a plurality of original sheets thereon and feeding said original sheets individually to an exposure station for illumination, an automatic original sheet transport apparatus having an original sheet receiving member for receiving the illuminated original sheets thereon, and an original sheet transport means for transporting the original sheets from said original sheet feed apparatus to said original sheet receiving member, said original sheet transport means capable of reversing each original sheet at least one time which original sheet is transported in one direction, during the transportation of the original sheet, so that said copy sheets and said original sheets are stacked in the order of their pages after copying of said originals.

7. A duplex copying machine as claimed in claim 6, wherein said two mentioned optical systems comprises a single optical system.

8. A duplex copying machine as claimed in claim 1, wherein said automatic original transport apparatus is detachable from said contact glass.

9. In a duplex copying machine of the type having a first sheet feed apparatus capable of stacking a plurality of copy sheets thereon and feeding copy sheets to a photoconductor to form toner images on the respective first sides of the copy sheets, and a second sheet feed apparatus capable of receiving the copy sheets with toner images on first sides thereof and feeding those copy sheets back to the photoconductor to form toner images on the respective second sides of these copy sheets, and a sheet outlet tray for receiving these copy sheets thereon after the copying process, the improvement comprising:

an original sheet feed apparatus adapted for stacking a plurality of original sheets thereon in an order of their pages and feeding these original sheets individually to an exposure station where they are illuminated each time they are fed.

an automatic original sheet transport apparatus having an original sheet receiving member for receiving the illuminated original sheets thereon, and an original sheet transport means for transporting the original sheets from said original sheet feed apparatus to said original sheet receiving member, said original sheet transport member operable to reverse at least one time each original sheet transported in one direction, during the transportation of the original sheet, so that the copy sheets and the original sheets are stacked in the order of their pages after copying of these sheet originals.

10. In a duplex copying machine of the type having a first sheet feed apparatus capable of stacking a plurality of copy sheets thereon and feeding copy sheets to a photoconductor to form toner images on the respective first sides of the copy sheets, and a second sheet feed apparatus capable of receiving said copy sheets and feeding said copy sheets back to said photoconductor to form toner images on the respective second sides of said copy sheets, and a sheet outlet tray for receiving said copy sheets thereon after the copying process, the improvement comprising:

an original sheet feed apparatus capable of stacking a plurality of original sheets thereon in an order of their pages with the respective first sides thereof down and feeding said original sheets individually to an exposure station for illumination in the reverse order of the pages of said stcked sheet originals with each original sheet being illuminated each time it is fed to the exposure station, and an automatic original sheet transport apparatus comprising an original sheet receiving member for receiving the illuminated sheet originals and an original sheet transport means for reversing said sheet originals fed from said original sheet feed apparatus after said sheet originals have passed through said exposure station and transporting said sheet originals to said original sheet receiving member, so that the copy sheets and the original sheets are stacked in the order of their pages after copying of said sheet originals.

11. In a duplex copying machine of the type having a first sheet feed apparatus capable of stacking a plurality of copy sheets thereon and feeding copy sheets to a photoconductor to form toner images on the respective first sides of the copy sheets, and a second sheet feed apparatus capable of receiving said copy sheets and feeding said copy sheets back to said photoconductor to form toner images on the respective second sides of said copy sheets, and a sheet outlet tray for receiving said copy sheets thereon after the copying process, the improvement comprising:

an original sheet feed apparatus capable of stacking a plurality of original sheets thereon with respective first sides thereon up and feeding said original sheets individually to an exposure station for illumination in the reverse order of the pages of said stacked original sheets with each original sheet being illuminated each time it is fed to the exposure station, and an automatic original sheet transport apparatus comprising an original sheet receiving member for receiving the illuminated original sheets thereon and an original sheet transport means for reversing said original fed from said original sheet feed apparatus, before and after said exposure station one time each, and transporting said original sheets to said original sheet receiving member, so that the copy sheets and the original sheets are stacked in the order of their pages after copying of said original sheets.

12. In a duplex copying machine of the type having a first sheet feed apparatus capable of stacking a plurality of copy sheets thereon and feeding copy sheets to a photoconductor to form toner images on the respective first sides of the copy sheets, and a second sheet feed apparatus capable of receiving said copy sheets and feeding said copy sheets back to said photoconductor to form toner images on the respective second sides of said copy sheets, and a sheet outlet tray for receiving said copy sheets thereon after the copying process, the improvement comprising:

an original sheet feed apparatus capable of stacking a plurality of original sheets theren with the respective first sides thereon up and feeding said original sheets individually to an exposure station for illumination in the reverse order of the pages of said stacked original sheets with each original sheet illuminated each time it is fed to the exposure station, and an automatic original sheet transport apparatus comprising an original sheet receiving member for receiving the illuminated original sheets thereon and an original sheet transport means for reversing said original sheets fed from said original sheet feed apparatus, at a location before said exposure station, and transporting said original sheets to said original sheet receiving member, so that said copy sheets and said original sheets are stacked in the order of their pages after copying of said original sheets.

13. In a duplex copying machine of the type having a first sheet feed apparatus capable of stacking a plurality of copy sheets thereon and feeding copy sheets to a photoconductor to form toner images on the respective first sides of the copy sheets, and a second sheet feed apparatus capable of receiving said copy sheets and feeding said copy sheets back to said photoconductor to form toner images on the respective second sides of said copy sheets, and a sheet outlet tray for receiving said copy sheets thereon after the copying process, the improvement comprising:

a first original sheet feed apparatus capable of stacking a plurality of duplex original sheets thereon and feeding said duplex original sheets individually to an exposure station, for illuminating and a second original sheet feed apparatus for receiving said original sheets which have passed through said exposure station and feeding said original sheets back to said exposure station for illumination with each sheet original illuminated each time it is fed to the exposure station, and an automatic original sheet transport apparatus having an original sheet receiving member for receiving the illuminated original sheets thereon, and a switching means for selectively switching the transportation of said original sheets which have passed through said exposure station to one of said second original sheet feed apparatus and said original sheet receiving member, and an original sheet transport means for reversing said original sheets fed from one of said first original sheet feed apparatus and said second original sheet feed apparatus one time after said original sheets have passed through said exposure station, so that said copy sheets and said original sheets are stacked in the order of their pages after copying of said original sheets.

14. In a duplex copying machine of the type having a first sheet feed apparatus capable of stacking a plurality of copy sheets thereon and feeding copy sheets to a photoconductor to form toner imates on the respective first sides of the copy sheets, and a second sheet feed apparatus capable of receiving said copy sheets and feeding said copy sheets back to said photoconductor to form toner images on the respective second sides of said copy sheets, and a sheet outlet tray for receiving said copy sheets thereon after the copying process, the improvement comprising:

a contact glass capable of stacking book originals thereon, an exposure optical system which exposes an original of said contact glass by moving said original on said contact glass, an automatic original transport apparatus disposed on said contact glass, said automatic original transport apparatus comprising an original sheet feed apparatus capable of stacking a plurality of original sheets thereon and feeding said original sheets individually to an exposure station with each original sheet illuminated each time it is fed to the exposure station, an original receiving member for receiving the illuminated original sheets, and an original sheet transport means for reversing said original sheets fed from said original sheet feed apparatus, at least one time during transportation of said original sheets and transporting said original sheets to said original sheet receiving member, so that the copy sheets and the original sheets are stacked in order of their pages after the copying process.

* * * * *